United States Patent [19]

Poppe

[11] Patent Number: 4,765,508

[45] Date of Patent: Aug. 23, 1988

[54] SHEET MATERIAL DISPENSING PACKAGE

[75] Inventor: Kenneth G. Poppe, Miamitown, Ohio

[73] Assignee: The Procter & Gamble Company, Cincinnati, Ohio

[21] Appl. No.: 907,449

[22] Filed: Sep. 15, 1986

[51] Int. Cl.[4] ..... B65H 1/00

[52] U.S. Cl. ..... 221/48; 221/63

[58] Field of Search ..... 221/33, 34, 47, 48, 221/50, 51, 53, 63

[56] References Cited

U.S. PATENT DOCUMENTS

| | | | |
|---|---|---|---|
| 3,369,700 | 2/1968 | Nelson | 221/63 |
| 3,482,734 | 12/1969 | Mierson | 221/63 |
| 3,583,597 | 6/1971 | Buttery et al. | 221/33 |
| 3,881,632 | 5/1975 | Early et al. | 221/50 |
| 4,265,366 | 5/1981 | Schillinger et al. | 221/33 |

*Primary Examiner*—F. J. Bartuska

*Attorney, Agent, or Firm*—Thomas J. Slone; Fredrick H. Braun; Richard C. Witte

[57] ABSTRACT

A sheet material dispensing package which includes a U-folded bundle of sheets of material and a carton wherein the carton includes integral elements for substantially obviating rotational shifting of the bundle during shipping and handling. In a preferred embodiment, lower distal corner portions of the more interior closure flaps of the carton are configured to extend sufficiently into the carton to engage side portions of the bundle to effectively key the bundle to the carton and thereby substantially preclude rotational shifting of the bundle inside the carton.

2 Claims, 4 Drawing Sheets

SHEET MATERIAL DISPENSING PACKAGE

DESCRIPTION

1. Field of the Invention

This invention pertains to dispensing packages for sheet material: in particular, packages which enable pop-up dispensing of facial tissues. Such packages may be somewhat cubical in shape and include a U-folded bundle of interleaved facial tissues albeit it is not intended to thereby limit the present invention.

2. Background Art

Substantially cubical-shape, pop-up dispensing packages of facial tissues are, for example, disclosed in U.S. Pat. No. 3,881,632 which issued May 6, 1975 to Allen D. Early et al. and U.S. Pat. No. 3,369.700 which issued Feb. 20, 1968 to H. N. Nelson. The Early et al package comprises a discrete (i.e., not integral) inverted Y-shape support over which a U-shape bundle of tissues is draped, and which support is said to substantially preclude bundle shifting during shipping and handling; and the Nelson package comprises no internal bundle support or anti bundle shifting means. Additionally, U.S. Pat. No. 4,265,366 which issued May 5, 1981 to Schillinger et al, discloses a Dispensing Container having an integral shelf for a bundle of sheets which shelf extends the full length of the container. As is apparent from the figures in Schillinger et al, the shelf would not obviate or preclude bundle shifting or rotation during shipping and handling. Thus, while the prior art has addressed and solved to some extent the problems associated with bundle shifting in dispensing packages of facial tissues and the like, they have not solved the problems in the manner of or the extent of the present invention.

DISCLOSURE OF THE INVENTION

The invention provides a dispensing package for flexible sheet material which package comprises a unitary carton and a U-folded bundle of flexible sheet material such as facial tissues. The bundle comprises a closed end portion; and two leg portions which are in confronting relation and which may have their distal end portions flared somewhat outwardly. The carton has a dispensing aperture in its top wall, and the bundle is disposed in the carton with the closed end of the U-folded bundle immediately subjacent the dispensing aperture. The carton further comprises integral anti-bundle-rotation means for restraining the bundle from rotating inside the carton during shipping and handling. In one aspect of the invention, the integral anti-bundle-rotation means preferably comprises key element portions of the carton which key elements are configured and disposed to extend between the confronting leg portions of the bundle whereby the bundle is keyed (i.e., mechanically interlocked) with respect to the carton and rotation of the bundle inside the carton is substantially precluded. The carton preferably comprises closure flaps and the key elements comprise key regions of the closure flaps: e.g., integrally hinged lower distal corner portions of the interior and closure flaps of the carton. The carton preferably further comprises a body portion to which the closure flaps are integrally hinged along proximal edges. The closure flaps may further comprise base regions which are disposed adjacent their proximal edges, and have their key regions cantilevered from and integrally hinged to their base regions.

BRIEF DESCRIPTION OF THE DRAWINGS

While the specification concludes with claims which particularly point out and distinctly claim the subject matter regarded as forming the present invention, it is believed that the invention will be better understood from the following description taken in conjunction with the accompanying drawings in which:

DETAILED DESCRIPTION OF THE INVENTION

Figure 1:
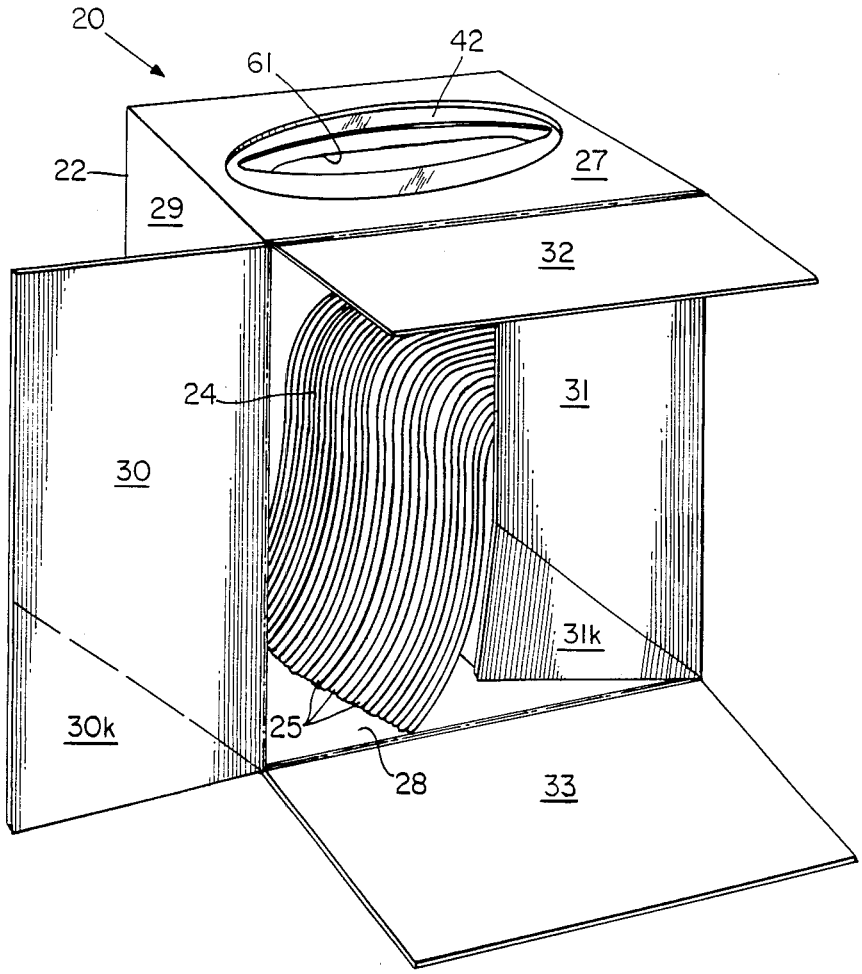
FIG. 1 is a perspective view of a dispensing package embodiment of the present invention in which some of the closure flaps on one end of the carton disposed are in open positions.

An exemplary embodiment of the present invention is shown in FIG. 1 and identified thereon as dispensing package 20 which comprises an integral carton 22, and a U-folded bundle 24 of facial tissues 25.

Figure 2:
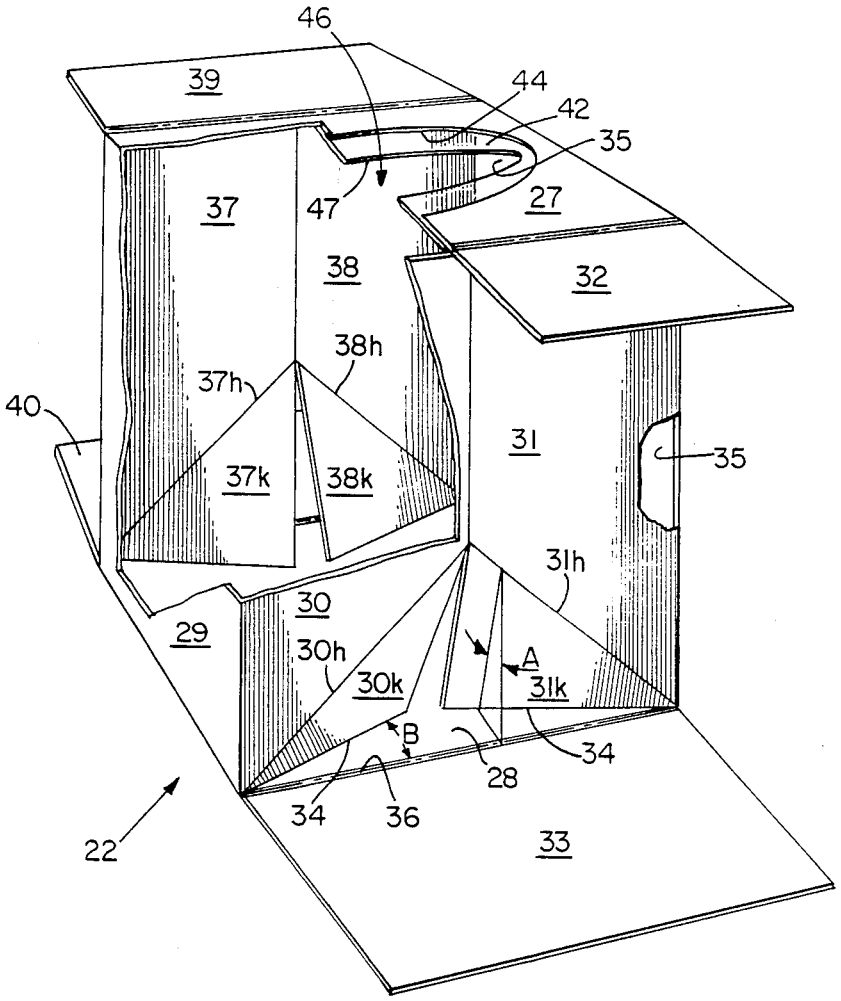
FIG. 2 is a fragmentary perspective view of the integral carton of the dispensing package shown in FIG. 1.

Still referring to FIG. 1, carton 24 is shown to comprise a top wall 27, a bottom wall 28, a front wall 29, minor flaps 30 and 31, and major flaps 32 and 33. In FIG. 2, carton 24 is shown to further comprise back wall 35, minor flaps 37 and 38, major flaps 39 and 40, and a dispensing opening panel 42. Further, top wall 27 is provided with a centrally disposed elongate (e.g., ellipsoidal) opening having an edge 44, and the dispensing opening panel 42 is provided with a dispensing aperture 46 which is defined by edge 47. Also, still referring to FIG. 2, lower distal corner portions of minor flaps 30, 31, 37 and 38 are designated key elements **30*k*, 31*k*, 37*k*, and 38*k*, respectively, and which are hinged along their proximal edges which are hereby designated hingelines 30*h*, 31*h*, 37*h*, and 38*h*, respectively, to parent portions of their respective minor flaps. Angles A, B are also identified in FIG. 2, and their functions are fully described hereinafter. Briefly, however, they indicate the degree of inward orientation of key elements 30*k*, 31*k*, 37*k* and 38*k* when the carton is erected, and which inward orientation of the key elements functions to mechanically interlock them with the U-folded bundle of tissues, FIG. 1, by extending somewhat into the space between the confronting leg portions of the bundle 24**.

Figure 4:
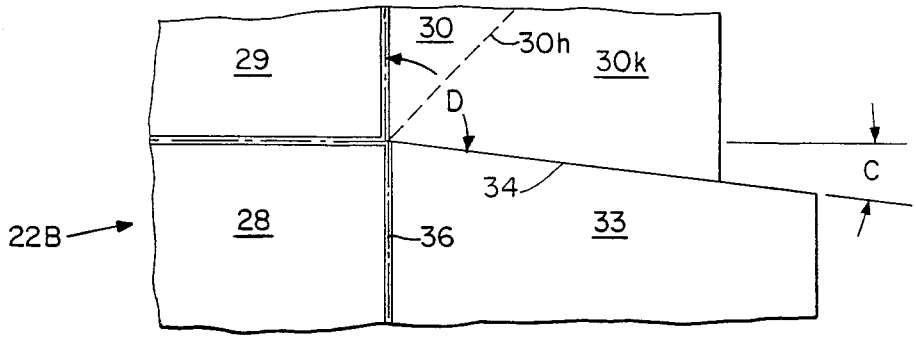
FIG. 4 is an enlarged scale view of a fragmentary portion of the carton blank shown in FIG. 3.

Briefly, referring to FIG. 1, the lower distal corner portions of the interior or minor end closure flaps of the carton are hinged to the proximal or base portions of their respective flaps, and are so configured that when the end closure flaps are closed and secured together, the lower distal corner portions slant inward at Angle A, and their bottom edges 34 form an angle B with respect to the bottom side edge 36 of the carton. In this embodiment of the invention, this slanting results from the bottom proximal corner angle D, FIG. 4, of the minor flap 30 being greater than a right angle by the size of angle C; and, due in part to the inherent stiffness of the cartonboard from which carton 22 is made, the slanting forces the lower distal corner portions of the flaps to engage the bundle in the region between the confronting leg portions of the bundle. In effect, this keys the bundle to the carton with integral key elements—i.e., the lower distal corner portions of the minor flaps of the carton—and substantially precludes shifting and/or rotation of the bundle within the carton due to shipping and handling forces.

An exemplary package 20, FIG. 2, may comprise a carton 22 having a length and width of about four and three eights inches each, and a height of about five and one-guarter inches: and have disposed therein a bundle of two ply tissues having lengths and widths of about nine-and-two-tenths inches by about eight-and-two tenths inches, respectively and which tissues number about one hundred. In this carton, the minor flaps are configured to provide an angle C, FIG. 4, of about six degrees. This, in turn, results in each of the lower distal corner portions 30*k*, 31*k* and 38*k* being slanted inward at an angle A, FIG. 2, of about five degrees. Of course, if greater keying—i.e., mechanical interlocking of the bundle to the carton—is desired, angle C can be increased to provide angle A of the desired size.

Figure 3:
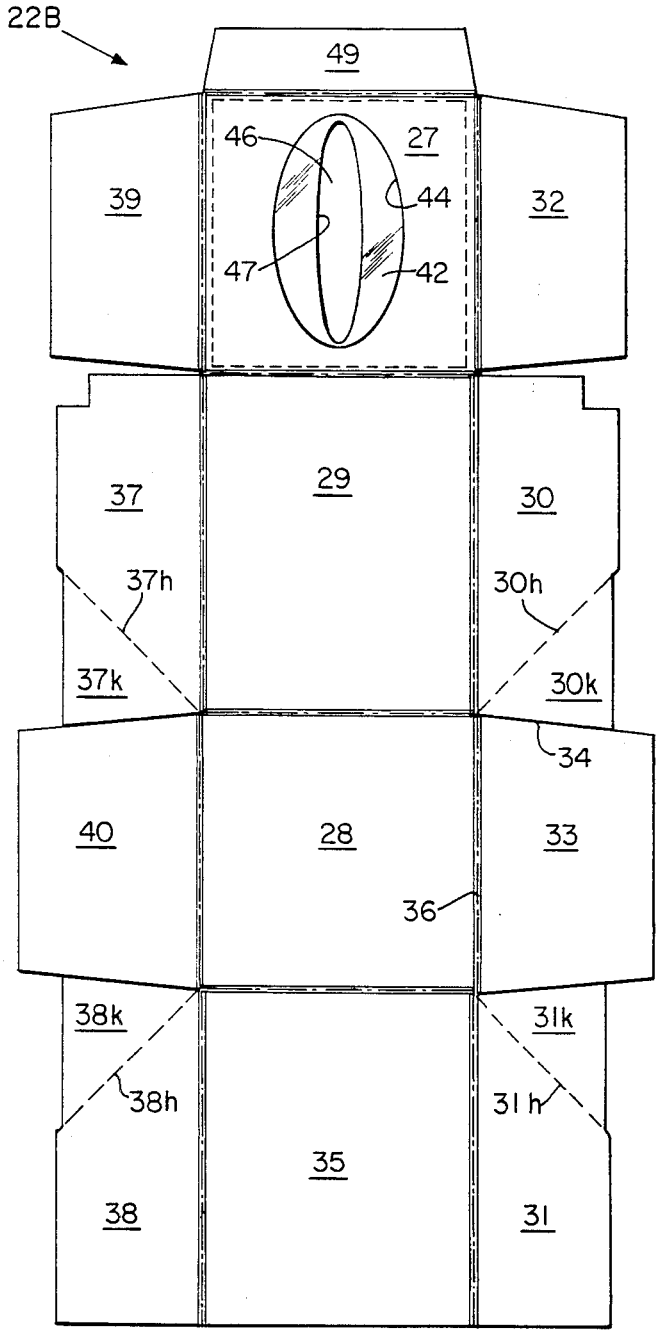
FIG. 3 is a plan view of a carton blank which, when erected, becomes a carton of the configuration shown in FIG. 2.
Figure 5:
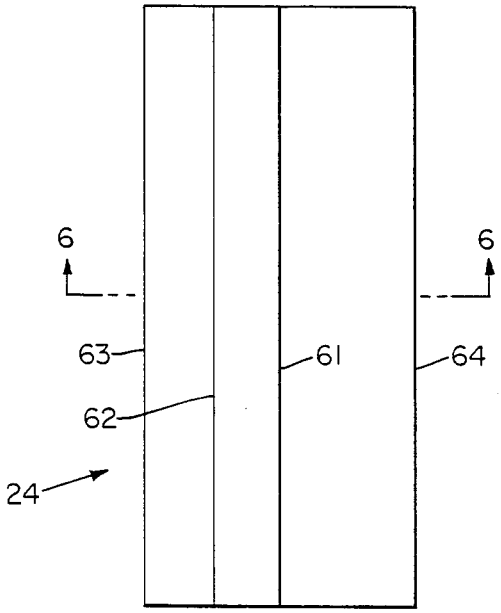
FIG. 5 is a top view of a parallelopipedal-shape bundle of interfolded facial tissues: i.e., a bundle of tissues which may be U-folded and inserted in a carton to complete a package of the configuration shown in FIG. 1.
Figure 6:
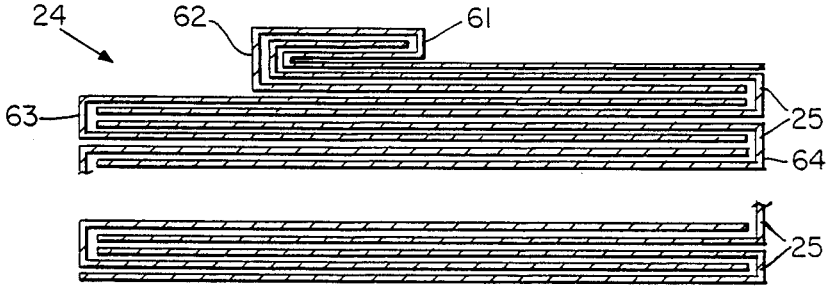
FIG. 6 is an enlarged scale sectional view taken along section line 6—6 of FIG. 5, and in which view the thicknesses of the facial tissues are exaggerated to more clearly depict their interleaved relations, and the geometry of the top folded tissues.

To assemble a package 20, FIG. 1, the glue flap 49 of carton blank 22B, FIG. 3 is glued to the inner edge of back wall 35; and the carton blank 22B is erected to form a generally parallelopipedal shape carton having open ends. Then a bundle of tissues such as shown in FIGS. 5 and 6 is U-folded, the ends flared over a shoe, and the bundle is pushed through a loading funnel into the erected carton. Then, the minor flaps are closed so that their lower distal corner portions extend somewhat between the legs of the bundle or otherwise sufficiently mechanically engage the ends of the bundle while the remainder portions of the minor flaps (i.e, their proximal portions) are disposed in coplanar relation. Then, after having applied glue to either outwardly facing surface areas of the minor flaps 30, 31, 37 and 38, or, preferable, to the inwardly facing surfaces of the major flaps 32, 33, 39 and 40, the major flaps are closed to thereby secure the ends closed. By orienting the bundle 24 in the carton 22 so that the grasping edge 61, FIGS. 1, 5 and 6, of the top folded tissue 25 is parallel with the major axis of dispensing aperture 46, FIG. 2, dispensing of the tissues can be commenced by pulling on the grasping edge portion. Removal of the first tissue will result in a portion of another tissue extending through the dispensing aperture to facilitate continuing pop-up dispensing.

Referring again to FIG. 3, in a preferred carton blank 22B, the top wall 27 is provided with a transparent dispensing aperture panel 42 which may be polyethylene film or the like although it is not intended to thereby limit the present invention to cartons having such panels. However, such panels are preferred because they result in quieter tissue withdrawals, and improve the esthetics of the package by providing visible product within the package.

Referring still to FIG. 3, the hinge lines 30*h*, 31*h*, 37*h* and 38*h* of carton blank 22B may be scored, or lines of perforations or slits to facilitate their acting as hinge-lines: i.e., preferentially bending there when the carton is erected, filled, and sealed as described above.

Referring now to FIGS. 5 and 6, bundle 24 of tissues 25 is shown to have medial or grasping edge 61, a quarter fold edge 62, and side edges 63 and 64 which are thus identified to facilitate understanding of the geometry of the bundle as described above, and as shown in the figures.

While particular embodiments of the present invention have been illustrated and described, it would be obvious to those skilled in the art that various other changes and modifications can be made without departing from the spirit and scope of the invention. It is, therefore, intended to cover in the appended claims all such changes and modifications that are within the scope of this invention.

What is claimed is:

1. A dispensing package for flexible sheet material, said package comprising a unitary carton and a U-folded bundle of sheets of flexible material, said bundle comprising a closed end and two leg portions in confronting relation, said carton having a top wall and a bottom wall, said top wall having a dispensing aperture therethrough, and said bundle being disposed in said carton with the closed end of said U-folded bundle immediately subjacent said dispensing aperture. said carton further comprising integral anti-bundle-rotation means for directly contacting and restraining said bundle from rotating inside said carton during shipping and handling, said integral anti-bundle-rotation means comprising a pair of integrally hinged end closure flaps having proximal portions and lower distal corner portions, said proximal portions of each said pair being substantially coplanar, said lower distal corner portions being integrally hinged to their respective proximal portions along integral hinge lines which extend obliquely upwardly from adjacent the respective bottom proximal corners of said end closure flaps, and said lower distal corner portions being configured and disposed to have their bottom edges resting on the bottom wall of said carton, and to slope downwardly and inwardly far enough to sufficiently engage the sides of said bundle to substantially obviate rotation of said bundle inside said carton.

2. A dispensing package for flexible sheet material which package comprises a unitary carton and a U-folded bundle of sheets of flexible material, said carton comprising a top wall having a dispensing aperture therethrough, a bottom wall, a front wall, a back wall, and two sets of end-wall-forming closure flaps, said bundle being disposed in said carton with the closed end thereof immediately subjacent said dispensing aperture, each of said sets of said end-wall-forming closure flaps comprising a pair of vertically hinged flaps having proximal portions and bottom distal corner portions which are connected along integral hinge-lines which extend obliquely upwardly from adjacent the bottom proximal corners of said flaps, said vertically hinged flaps being so configured and disposed that said proximal portions of each said pair of vertically hinged flaps are disposed in coplanar relation, and so that said lower distal corner portions slant downwardly and inwardly with their bottom edges against said bottom wall, said lower distal corner portions of said flaps being configured to extend inwardly far enough to sufficiently mechanically interlock them with said bundle that they comprise integral means for substantially restraining said bundle from rotating inside said carton during shipping and handling.

* * * * *